US005791481A

United States Patent [19]

Thomas

[11] Patent Number: 5,791,481

[45] Date of Patent: Aug. 11, 1998

[54] ELASTIC RETAINING ASSEMBLY

[76] Inventor: Janice Gore Thomas, 3614 Montrose Blvd., #703, Houston, Tex. 77006

[21] Appl. No.: 781,081

[22] Filed: Jan. 9, 1997

[51] Int. Cl.[6] ..... B65D 75/00

[52] U.S. Cl. ..... 206/581; 383/38; 220/507

[58] Field of Search ..... 383/38, 39, 40; 220/500, 507, 9.1; 206/581, 823, 216

[56] References Cited

U.S. PATENT DOCUMENTS

| | | | |
|---|---|---|---|
| 2,473,429 | 6/1949 | Hinman | 383/39 X |
| 3,360,179 | 12/1967 | Carstens | 229/15 |
| 4,542,826 | 9/1985 | Adams | 206/427 |
| 4,542,930 | 9/1985 | Adams | 294/160 |
| 4,877,068 | 10/1989 | Blake | 141/390 |
| 5,377,833 | 1/1995 | Ranger | 206/430 |
| 5,503,476 | 4/1996 | Hamdan | 383/38 X |

*Primary Examiner*—Jacob K. Ackun
*Attorney, Agent, or Firm*—Joseph N. Breaux

[57] ABSTRACT

A travel aid in the form of an elastic retaining assembly that includes a plurality of tubular compartments formed by stitching together a plurality of substantially rectangular side panels constructed from elastic material and a plurality of tray members constructed from elastic material and each having a central panel positioned between two stitching panels. In a preferred embodiment, the plurality of tubular compartments includes different sized tubular compartments.

1 Claim, 2 Drawing Sheets

ELASTIC RETAINING ASSEMBLY

TECHNICAL FIELD

The present invention relates to devices for securing multiple items for transport and more particularly to an elastic retaining assembly having a plurality of parallel, tubular compartments constructed from elastic material in a manner to allow the elastic material to stretch and allow insertion within each of the tubular compartments of a item, such as make-up bottles, perfume, lotions, hair spray, shampoo, etc., for transporting. The items are held in place by the elastic forces and are prevented from falling and knocking into each other reducing the risk of breakage.

BACKGROUND OF THE INVENTION

Many travelers prefer to bring a number items such as make-up bottles, perfume bottles, lotion bottles, hair spray cans and bottles, shampoo bottles, etc. along with them when traveling. Although the items can bring comfort to the traveler, the number of different items pose a packing problem and often the bottles strike one another during transporting causing breaks and leaks to occur. These breaks and leaks can ruin the contents of a travel bag and result a spoiled trip. It would be a benefit, therefore, to have a retaining assembly that could be used to hold and secure a number of separate items such as previously mentioned in a convenient manner and in a manner that reduces the chances that the items will break or open during transporting.

SUMMARY OF THE INVENTION

It is thus an object of the invention to provide a retaining assembly that can hold and secure a number of separate items in a convenient manner and in a manner that reduces the chances that the items will break or open during transporting.

It is a further object of the invention to provide a retaining assembly that is constructed from an elastic material and includes a number of elastic walled tubular compartments within which items to be transported can be inserted and held for transporting.

It is a still further object of the invention to provide a elastic retaining assembly that is constructed by stitching a number of elastic side panels to a number of elastic tray members to form a number of elastic walled tubular compartments within which items to be transported can be inserted and held for transporting.

It is a still further object of the invention to provide a elastic retaining assembly that accomplishes all or some of the above objects in combination.

Accordingly, an elastic retaining assembly is provided. The retaining assembly includes a plurality of tubular compartments formed by stitching together a plurality of substantially rectangular side panels constructed from elastic material and a plurality of tray members constructed from elastic material and each having a central panel positioned between two stitching panels. In a preferred embodiment, the plurality of tubular compartments includes different sized tubular compartments.

BRIEF DESCRIPTION OF THE DRAWINGS

For a further understanding of the nature and objects of the present invention, reference should be had to the following detailed description, taken in conjunction with the accompanying drawings, in which like elements are given the same or analogous reference numbers and wherein.

DESCRIPTION OF THE EXEMPLARY EMBODIMENT

Figure 1:
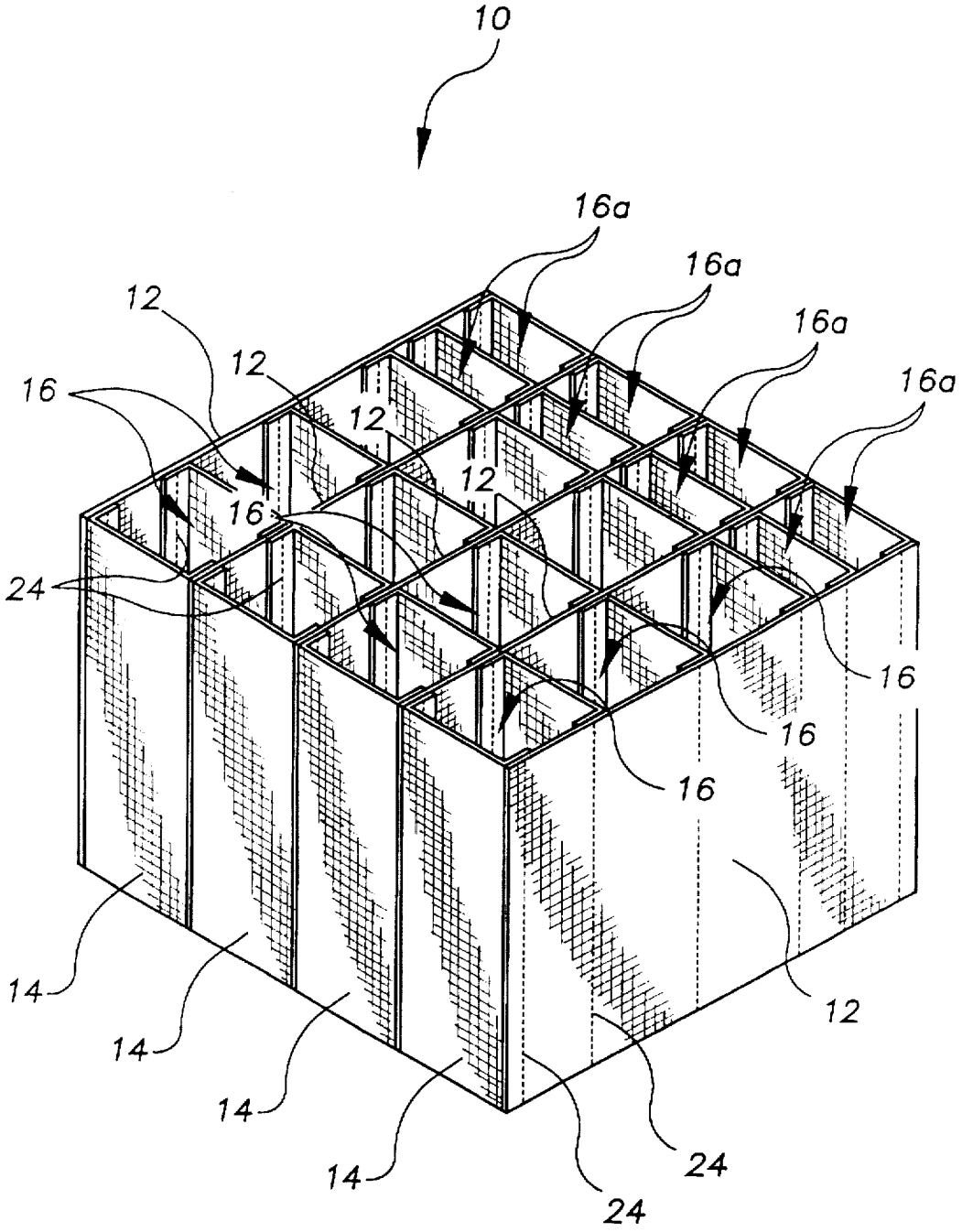
FIG. 1 is a perspective view of an exemplary embodiment of the elastic retaining assembly of the present invention showing the five elastic side panels and the twenty-four elastic tray members stitched together to form a four by five grid containing twenty elastic retaining pockets.
Figure 2:
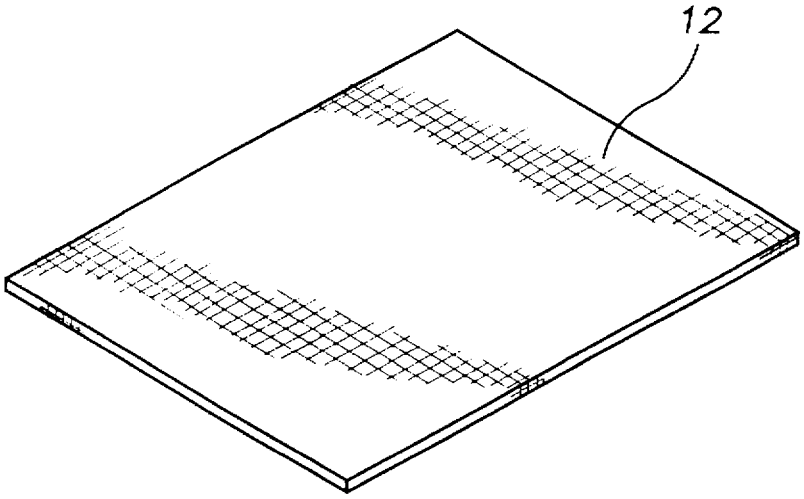
FIG. 2 is a perspective view of one of the five elastic side panels of the elastic retaining assembly of FIG. 1.
Figure 3:
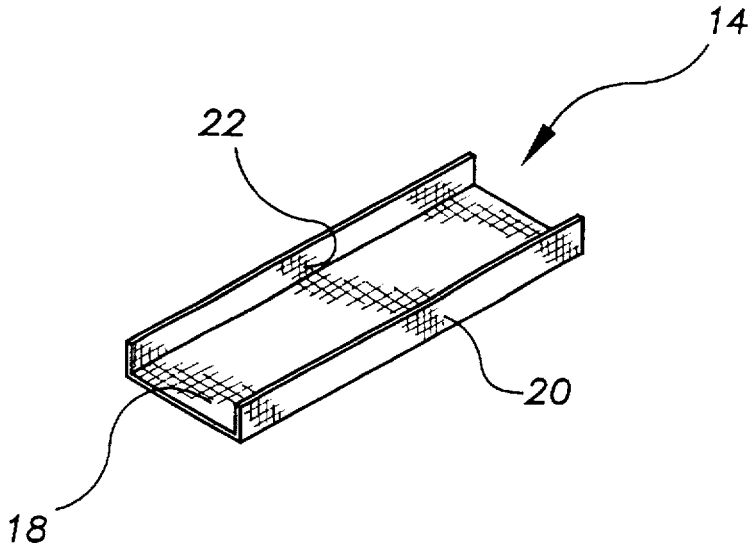
FIG. 3 is a perspective view of one of the elastic tray members of the elastic retaining assembly of FIG. 1 in isolation showing the central portion and the two right angled stitching portions.

FIG. 1 shows an exemplary embodiment of the elastic retaining assembly of the present invention generally designated by the numeral 10. Retaining assembly 10 includes five elastic side panels 12 and twenty-four elastic tray members 14 that are stitched together to form twenty, parallel aligned, tubular compartments 16. With reference to FIG. 2, side panels 12 are substantially rectangular and constructed from conventional elastic material. With reference to FIG. 3, tray members 14 are constructed from conventional elastic material and have a central panel 18 positioned between two stitching panels 20,22. Referring back to FIG. 1, stitching panels 20,22 are stitched to side panels 12 using conventional lock stitches 24.

It can be seen that items such as hair spray, shampoo, perfume, etc can be inserted into and elastically held by tubular compartments 16 during transporting in a suit case or other luggage item. The elastic gripping action of tubular compartments 16 minimizes contact between the small items and reduces the incidence of breakage and leakage. In this embodiment, eight tubular compartments 16*a* are sized smaller than the rest of tubular compartments 16 to provide secure holding for smaller items such as lipsticks, deodorant etc.

It can be seen from the preceding description that a retaining assembly has been provided that can hold and secure a number of separate items in a convenient manner and in a manner that reduces the chances that the items will break or open during transporting; that is constructed from an elastic material; that includes a number of elastic walled tubular compartments within which items to be transported can be inserted and held for transporting; and that is constructed by stitching a number of elastic side panels to a number of elastic tray members to form a number of elastic walled tubular compartments within which items to be transported can be inserted and held for transporting.

It is noted that the embodiment of the elastic retaining assembly described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A elastic retaining assembly comprising:

a first plurality of substantially rectangular side panels constructed from elastic material; and a second plurality of tray members constructed from elastic material, each of said second plurality of tray members having a central panel positioned between two stitching panels;

said first plurality of side panels and said second plurality of tray members being stitched together to form a third plurality of open top and bottom tubular compartments, a number of said third plurality of tubular compartments being sized smaller than a remainder of said third plurality of tubular compartments.

* * * * *